United States Patent [19]

Volland et al.

[11] Patent Number: 4,586,543

[45] Date of Patent: May 6, 1986

[54] DEVICE FOR THE ROTATIONAL DRIVE OF A WEFT PREFEED AND MEASUREMENT APPARATUS IN A SHUTTLE-LESS WEAVING MACHINE

[75] Inventors: Michel Volland, Bourgoin Jailleu; Roger Fourneaux, La Tour du Pin; Pierre Rémond, Bourgoin Jailleu, all of France

[73] Assignee: Saurer Diederichs (Societe Anonyme), Bourgoin Jailleu, France

[21] Appl. No.: 623,978

[22] Filed: Jun. 25, 1984

[30] Foreign Application Priority Data

Jul. 7, 1983 [FR] France ..... 83 11843

[51] Int. Cl.[4] ..... D03D 47/36

[52] U.S. Cl. ..... 139/452; 242/47.01

[58] Field of Search ..... 139/452; 242/47.01, 242/47.12, 47.13; 66/232

[56] References Cited

U.S. PATENT DOCUMENTS 3,950,942 4/1976 Namura ..... 66/232
4,372,349 2/1983 Van Mullekom ..... 139/452
4,452,402 6/1984 Ghiardo ..... 242/47.01

FOREIGN PATENT DOCUMENTS 2419694 11/1974 Fed. Rep. of Germany .
2107747 5/1983 United Kingdom .

*Primary Examiner*—Henry S. Jaudon
*Assistant Examiner*—Steven Shongut
*Attorney, Agent, or Firm*—Karl F. Ross; Herbert Dubno

[57] ABSTRACT

This device designed for weaving machines enabling a weft selection, comprises for each prefeed and measurement device (1), an electric drive motor (8) having a controlled angular position, such as a "step" motor. The angular position of the main shaft (14) of the weaving machine, detected by means of a coder wheel (24), is converted into pulses (D) which are supplied by a "switching system" (15) which may be switched from the weft selection control (16) to the electronic power circuit (17) associated with the motor (8) of the prefeed device (1) selected. It is therefore possible to drive the shaft (5) of the selected prefeed device through a predetermined number of rotations synchronously with the rotation of the main shaft (14) of the weaving machine.

5 Claims, 6 Drawing Figures

DEVICE FOR THE ROTATIONAL DRIVE OF A WEFT PREFEED AND MEASUREMENT APPARATUS IN A SHUTTLE-LESS WEAVING MACHINE

FIELD OF THE INVENTION

The present invention relates to a device for the rotational drive of a weft prefeed and measurement apparatus in a shuttle-free weaving machine with a lateral weft store and insertion of the weft by means of a pneumatic fluid. This invention relates, more particularly, to a loom having a weft selector enabling either of two or more weft threads supplied by the same number of separate spools forming weft stores to be inserted at will. For this purpose, there is inserted along the path of each weft thread a prefeed and measurement apparatus which stores, in a cyclical manner, a predetermined weft length which is a function of the width of the fabric, and which enables this temporarily stored length of weft to be called up and drawn in a single operation at the time of picking.

BACKGROUND OF THE INVENTION

A weft prefeed and measurement apparatus may comprise, as disclosed in the U.S. Pat. Nos. 4,132,370 and 4,238,080, a tubular finger rigid with a rotary shaft having an axial channel drilled therein which enables the inlet of the weft and its passage through the tubular finger and which provides for the winding of the weft in turns about a drum which is rotationally fixed. During each cycle the shaft should carry out a predetermined number of rotations N so that the finger winds a length of weft of N turns corresponding to the width of the fabric about the drum.

If the weaving machine is designed to carry out a weft selection, it comprises at least two prefeed and measurement devices for the weft, which devices are coupled to rotary drive means. In addition, special devices must be provided in order to obtain the selective rotary drive of the shaft of one or other of the prefeed and measurement devices. This selective rotary drive should satisfy several conditions:

It should operate synchronously with the overall operation of the weaving machine.

It should be possible to control it in correspondence with the selection of the weft for weaving, such that a length of the correct stored weft is always available for insertion in accordance with the machine program.

Each time that a weft prefeed and measurement device is actuated, its shaft should perform a predetermined number of rotations in order to wind the number of turns of the thread corresponding to the width of the fabric, or a multiple of this number of turns in the case of several successive insertions of the same weft.

In addition, the tubular finger of each prefeed and measurement apparatus should occupy, at the beginning and each of each operating cycle, a predetermined angular position so that the turns may be suitably called up.

In order to satisfy these conditions, it has already been envisaged to use a drive device which may be disengaged and is interposed between a motor element which is caused to rotate in a permanent manner synchronously with the overall operation of the weaving machine, and an output shaft connected to the weft prefeed shaft, for example by means of a synchronous belt transmission. The main element of this device is a clutch-brake comprising a plurality of coaxial members whose coupling or disconnection are controlled by the admission of a pressurized fluid, in particular compressed air, the structure being such that certain pneumatic connections are only established between predetermined relative positions of the various coaxial members.

The clutch-brake of this device is relatively complex from the point of view of construction and does not correspond to any commercially available product. Both pneumatic circuits and electrical circuits, for the control of an electrovalve disposed at the pressurised fluid intake, are required for the operation and control of this clutch-brake. In addition, although this device automatically compensates coupling and braking errors, it does not ensure the precise positioning of the tubular finger of the prefeed apparatus at the beginning and end of each operating cycle. Finally it is necessary to provide a mechanical connection between the main shaft of the weaving machine and all the weft prefeed and measurement devices.

OBJECT OF THE INVENTION

The present invention has as its object, the provision of a rotary drive device for weft prefeed and measurement apparatus with no mechanical connection with the main shaft of the weaving machine, which device may be constructed solely with products which are available, and therefore inexpensive, only requires a single power source for its operation and control, and provides the weft prefeed and measurement apparatus with a rotary drive which is completely synchronous with the operation of the weaving machine, as well as extremely precise initial and final angular positions, even if the speed of the weaving machine is subject to fluctuations.

SUMMARY OF THE INVENTION

For this purpose, the rotary drive device of the invention for a weft prefeed and measurement apparatus in a shuttle-less weaving machine of the type described in the preamble, comprises, for each weft prefeed and measurement device, an electric motor with a controlled angular position having its output shaft coupled to the shaft of the prefeed and measurement apparatus, and also comprises a control assembly composed of electronic power circuits associated with the various electric motors, means for detecting the angular position of the main shaft of the weaving machine and for translating this position into electrical signals, and means which may be switched from the weft selection control and are designed to process the electrical pulses supplied by the said detection means, by supplying them to the power circuits associated with the electric motor of the weft prefeed and measurement devices selected.

This therefore provides a drive device all of whose power and control elements are electrical, and in which each weft prefeed and measurement device is coupled, for example, to a stepping electric motor, whose angular position is controlled from the detection of the position of the main shaft of the weaving machine, so as to enable, in particular, a rotation of this motor which is completely synchronous with that of the main shaft.

In addition, it is advisable to provide acceleration and deceleration controls, bearing in mind the speed of rotation to be obtained for each weft prefeed and measurement device and the inertia to be overcome. For this purpose, in accordance with a preferred embodiment of the device of the invention, the means for detecting the angular position of the main shaft of the weaving machine and for translating this position into electrical signals comprise a coder wheel connected in a rotational manner with the said shaft and comprising three concentric circular tracks. A first of these tracks comprises unequally spaced divisions provided such that each angular interval between two successive divisions corresponds to a basic rotation of a step motor during a stage in which the associated prefeed device is accelerated. A second track comprises equally spaced divisions for controlling the rotation at a constant speed of a prefeed device. The third track comprises unequally spaced divisions provided such that each angular interval between two successive divisions corresponds to a basic rotation of a step motor during a stage in which the associated prefeed device is decelerated, the signals produced by these three tracks being transmitted to the means which may be switched by the weft selection control and which are designed to supply the pulses to the power circuits. In this embodiment the three-track coder wheel supplies the pulses which may be used during the acceleration, operation at constant speed and deceleration stages directly and at each rotation. The means which may be switched therefore comprise a simple "switching system" whose function is to select the pulses which they receive and to direct these pulses to the control circuit of the selected prefeed device, or possibly to two circuits simultaneously, since during a weft change the acceleration of one of the prefeed devices takes place during the deceleration of another prefeed device. The coder wheel may comprise a fourth track, coaxial to the three previous tracks and provided with a single marker, and designed to supply a track switching signal at each rotation and in a suitably selected angular position.

In accordance with a further embodiment of the invention, the means for detecting the angular position of the main shaft of the weaving machine and for translating this position into electrical signals comprise a simple coder wheel connected in a rotational manner with the said shaft, i.e. with a single track comprising equally spaced divisions, whereas the means which may be switched from the weft selection control and are designed to process the pulses supplied by the coder wheel comprise a function generator which is designed to convert the pulses received into different pulses which may be used for the acceleration control and for the deceleration control of a prefeed device. In this case, the means in question perform a real processing of the signals in accordance with various functions selected in correspondence with the weft selection stage in progress (maintenance of a specific weft or changing of the weft).

In accordance with a further embodiment of the invention, each weft prefeed and measurement device is coupled to a d.c. electric motor, of the servo-operated type, a position sensor being provided in order to detect the angular position of the shaft of this electric motor and in order to supply the servo return signal. This approach is compatible with the use of a special three-track coder wheel or a simple coder wheel, in accordance with the arrangements described above.

BRIEF DESCRIPTION OF THE DRAWING

Further details of the invention are given in the following description with reference to the attached drawing which shows, by way on non-limiting example, several embodiments of this rotary drive device for weft prefeed and measurement apparatus. In the drawing.

SPECIFIC DESCRIPTION

Figure 1:
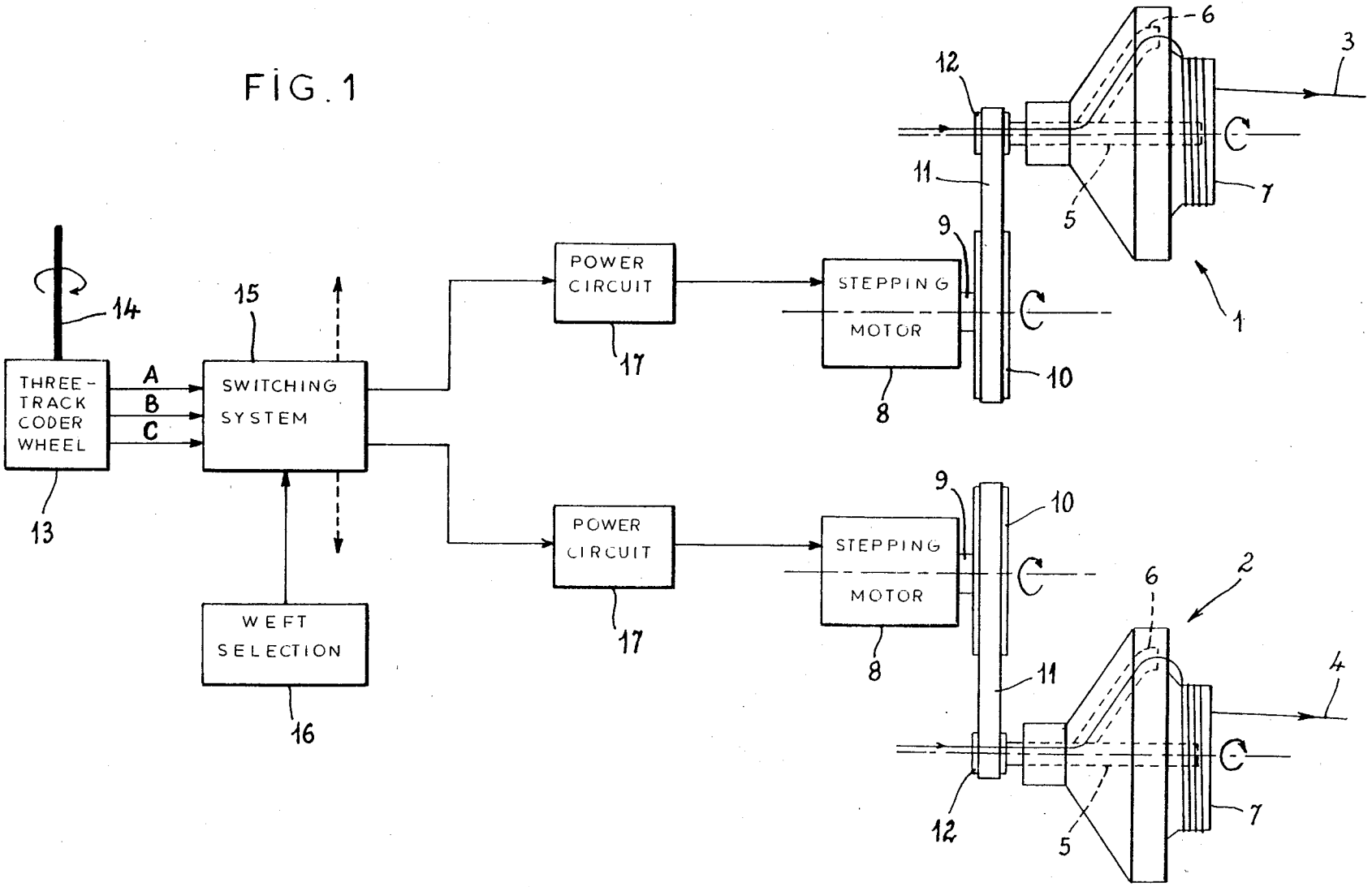
FIG. 1 is a diagrammatic overall view of the drive devices for two weft prefeed and measurement devices, with stepping motors, the position of the main shaft of the weaving machine being detected by a three-track coder wheel.

In FIG. 1, two identical weft prefeed and measurement devices 1, 2 are disposed in the same shuttle-less weaving machine and each enables the storage and release in a single operation of a predetermined length of weft thread 3, 4. In a known manner, each prefeed device 1, 2 comprises a rotary shaft 5 having an axial channel drilled in it via which the corresponding weft 3, 4 arrives. The shaft 5 supports a substantially radial tubular finger 6 through which the thread also passes. The rotation of the finger 6 causes a predetermined number of turns of thread N corresponding to the weft length 3, 4 to be inserted to be wound around a fixed drum 7. The invention enables the selective drive of one or other of the two prefeed devices 1, 2 in accordance with the weft 3, 4 selected by causing its shaft 5 to perform a number of rotations which is equal to N or is a multiple of N.

For this purpose, each prefeed device 1, 2 is associated with an electric stepping motor of the step type 8 whose shaft 9 supports a pulley 10 which, by way of a notched belt 11 or a similar synchronous transmission device, drives a further pulley 12 supported by the shaft 5 of the corresponding prefeed device 1, 2. The electric step motors 8 are actuated, supplied and stopped in accordance with the operation of the weaving machine, by a control assembly shown by a block diagram on the left-hand side of FIG. 1.

A coder wheel device 13, which will be described in further detail below, is coupled to the main shaft 14 of the weaving machine. The coder wheel device 13 detects the angular position of the shaft 14 and supplies the electrical pulses A, B, C provided for the control of the acceleration stages the operation at constant speed in synchronism with the shaft 14, and the deceleration stages of a motor 8 respectively, i.e. of a prefeed device. The pulses A, B, C are all supplied to an electronic "switching system" 15, which may be switched from the weft selection control 16. As a function of the commands which it receives from the control 16, the switching system 15 selects the pulses A, B, C and supplies them to one or other of the electronic power circuits 17 associated with the various step motors 8. As shown by the arrows in dashed lines, the number of prefeed devices, and therefore of motors 8, is not limited to two and the switching system 15 is common to all the prefeed devices whatever their number.

Figure 2:
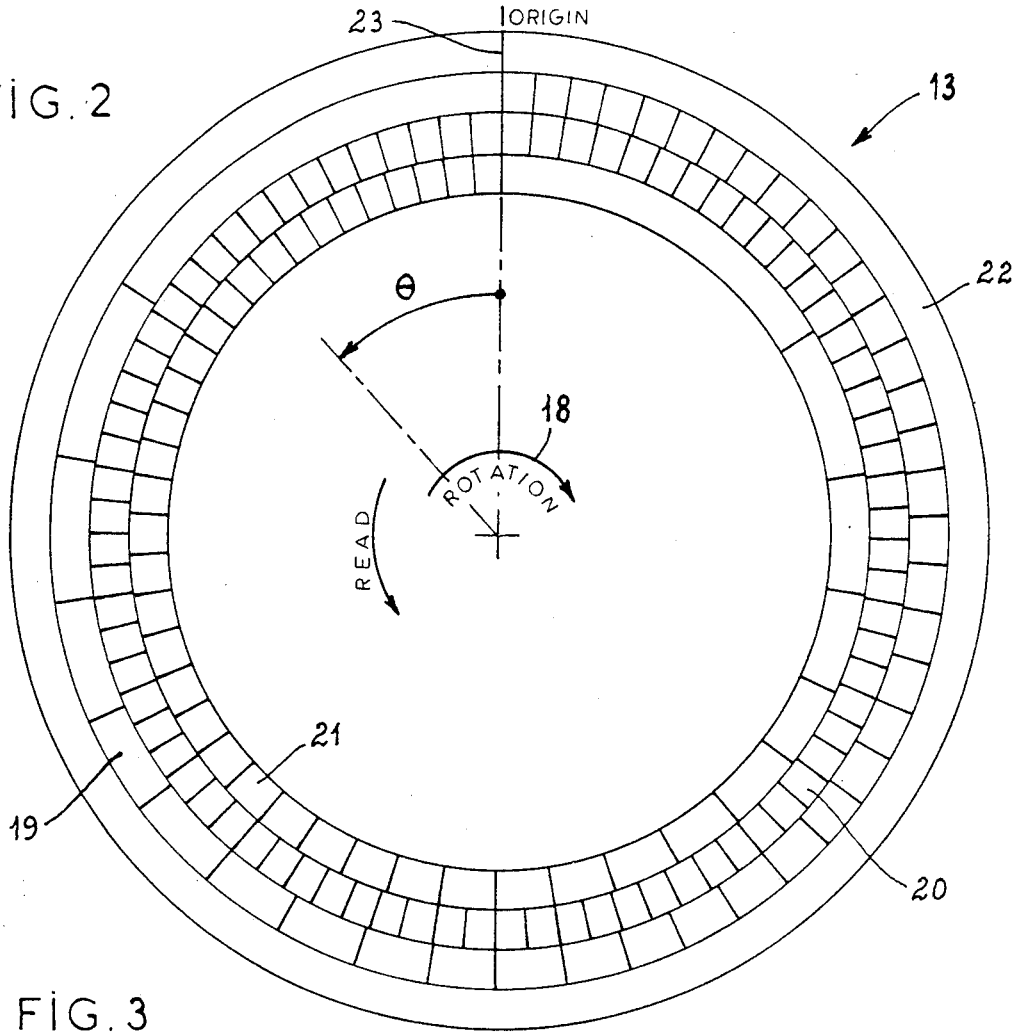
FIG. 2 is a detail view showing this three-track coder wheel.

FIG. 2 shows an embodiment of the coder wheel 13, whose direction of rotation is shown by an arrow 18. This special coder wheel comprises three main concentric circular tracks 19, 20, 21.

The external track 19, which is designed to generate the pulses A which control the acceleration stages, is provided with divisions separated by angular intervals or "pitches" which decrease in size. The entire track 19 may, for example, be provided with 400 divisions whose angular positions $\theta$, defined from a specific origin and expressed in degrees, are given by the formula:

$$\theta = 18\sqrt{p}$$

in which p may be any of the whole numbers from 1 to 400.

The central track 20, which is designed to generate the pulses B which control the stages of operation at a constant angular speed, is provided with equally spaced divisions. For example, the entire track 20 may be provided with 800 divisions which are separated by angular "pitches" p which, expressed in degrees, are all equal to:

$$p=(360/800)=0.45^\circ$$

The internal track 21, designed to generate the pulses C which control the deceleration stages, is provided with divisions separated by increasing angular intervals or "pitches".

The entire track 21 may, for example, be provided with 400 divisions whose angular positions $\theta$, defined from a specific origin and expressed in degrees, are given by the formula:

$$\theta = 360 - 18\sqrt{400 - p}$$

in which p may be any of the whole numbers from 1 to 400.

The coder wheel may further comprise, for example in an external position, a fourth circular track 22 which is coaxial to the previous tracks and is simply provided with a single marking 23 which is designed to generate, on each rotation and at the desired time, a track switching signal. The position of the marking 23 corresponds to the origin used for the definition of the angular values given by the above formulae. The detection of this marking 23 in no case causes the motor 8 to rotate.

When a weft prefeed and measurement device 1, 2 which has been selected is to be actuated, after it has been designated by the weft selection control 16, the pulses A generated by the track 19 are taken up from the time at which the switching signal given by the marking 23 is emitted, and these pulses A are supplied via the "switching system" 15 to the power circuit 17 associated with this prefeed device. A basic rotation of the stepping motor 8 which drives this prefeed device corresponds to each pulse A, and the spacing of the pulses A, corresponding to the particular characteristics of the track 19 described above, enables the rotation of the motor 8 to be uniformly accelerated between the stop position and a maximum speed Vm.

If the stepping motor 8 corresponding to the weft selected is to perform several successive rotations after it has been actuated, use is made, after the next switching signal provided by the marking 23, of the pulses B generated by the track 20. These uniformly spaced pulses B, which are supplied by the switching system 15 to the same power circuit 17, enable the same stepping motor 8 to be rotated at a constant speed equal to the maximum speed Vm reached at the end of the acceleration stage.

When a further weft is selected, and from the switching signal given by the marking 23, use is made of the pulses C generated by the track 21, these pulses still being supplied by the switching system 15 to the same power circuit 17. A basic rotation of the stepping motor 8 in question corresponds to each pulse C, and as the spacing of the pulses C corresponds to the particular characteristics of the track 21 described above, the rotation of the motor 8 may be decelerated in a uniform manner from its maximum speed Vm to its complete stoppage. After one rotation of the coder wheel 13 the deceleration stage is complete and the motor 8 is stationary.

Bearing in mind the characteristics of the three tracks 19, 20, 21 of the coder wheel 13, and in particular the fact that the number of divisions of the tracks 19, 21 is equal to half the number of divisions of the track 20, it can be seen that the acceleration and deceleration stages take place over a rotation of the motor 8 which is equal to half of the rotation required to provide a weft length and consequently that the motor 8 performs, each time it is actuated, a number of rotations such that it drives the shaft 5 of the associated prefeed device through a whole number of turns. If the motor 8 is to provide a single weft length, the deceleration stage is initiated directly after the acceleration stage, and switching is carried out directly from the pulses A to the pulses C.

In the context of the overall operation of the weaving machine, and considering the time at which a weft change is to be carried out, the acceleration stage for the step motor 8 corresponding to the new weft selected takes place simultaneously with the deceleration stage of the step motor 8 corresponding to the previously selected weft.

Figure 3:
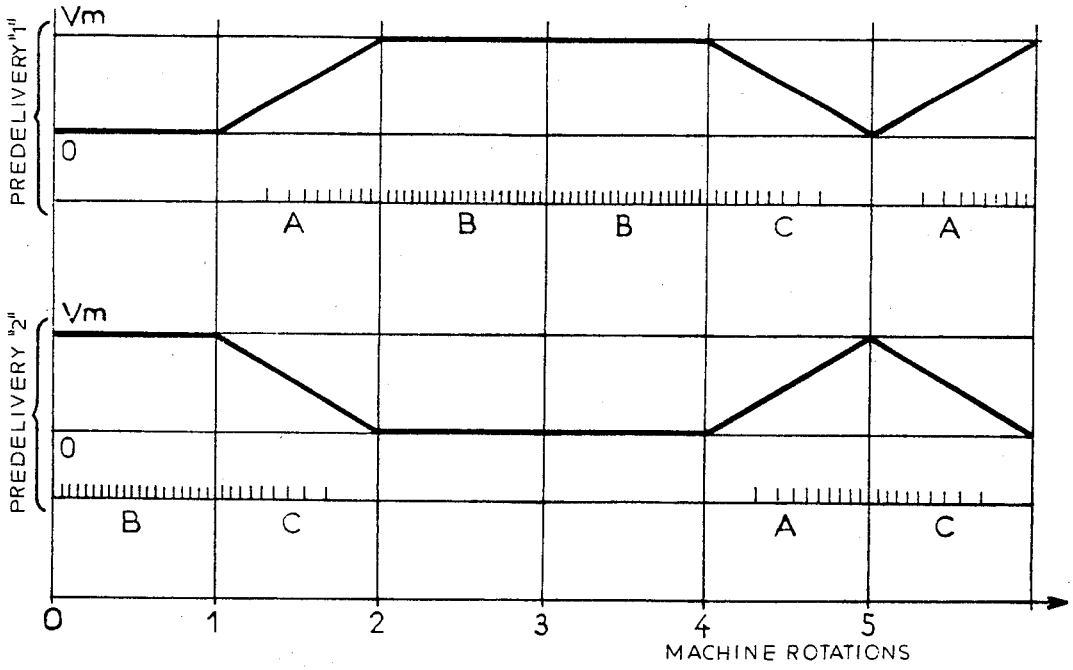
FIG. 3 is a diagram showing the operation of the devices of FIGS. 1 and 2.

FIG. 3 shows, in diagram form, the overall operation of two weft prefeed and measurement devices 1, 2 taking as an example a sequence in which the drive motor of the first prefeed device is to provide several weft lengths, after which the drive motor of the second prefeed device is to provide a single weft length. The number of rotations performed by the main shaft 14 of the weaving machine is shown on the abscissa. The speed (varying between the values O and Vm), on one hand, and the pulses A, B, C taken up during each operating stage, on the other hand, are shown for the motor of each prefeed device 1, 2. This diagram clearly shows the correspondence between the stoppage and operating periods of the two prefeed devices, as well as the take-up of the pulses A during the acceleration stages, the pulses B for operation at constant speed (Vm) and the pulses C during the deceleration stages.

Figure 4:
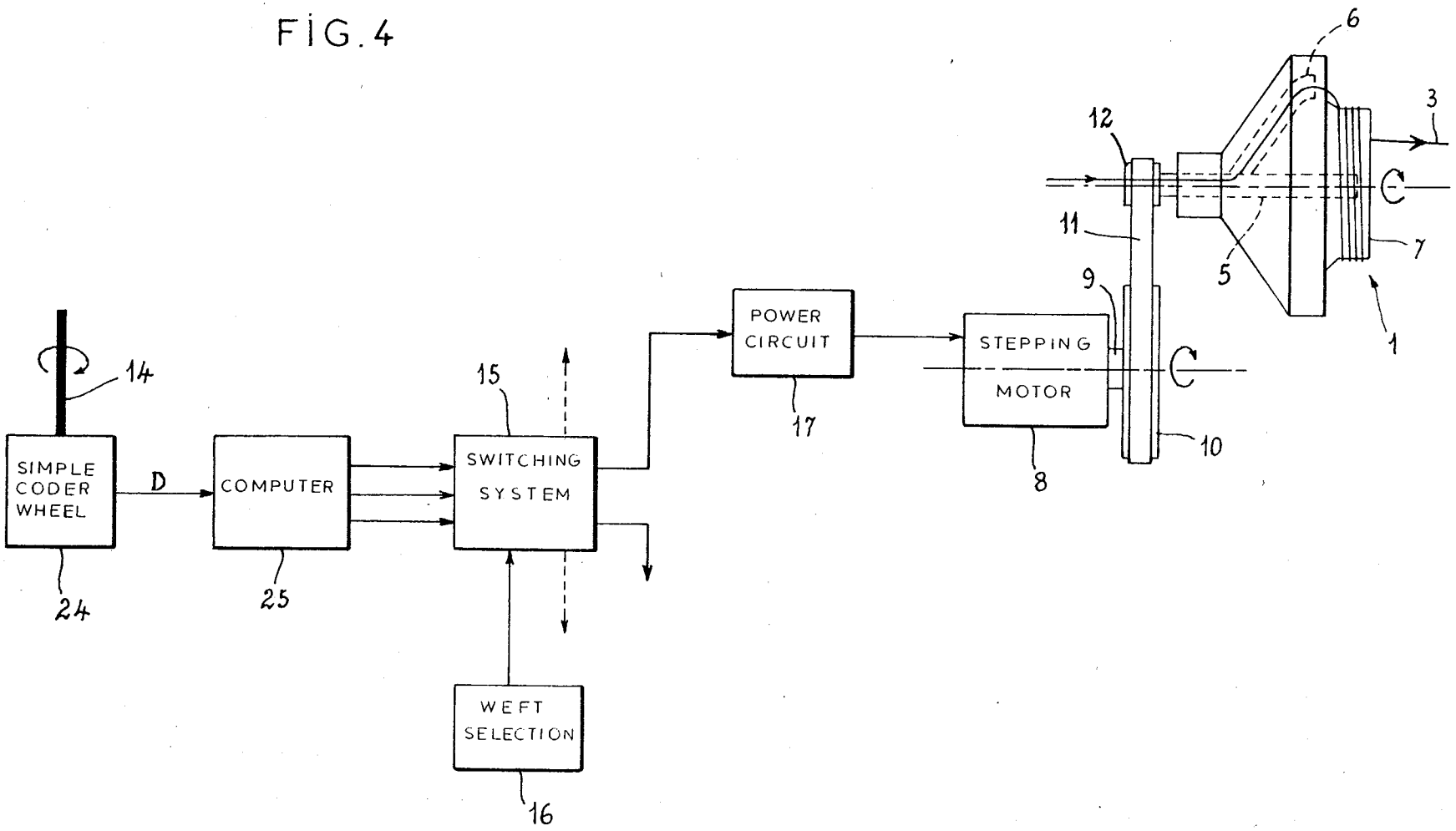
FIG. 4 is a diagrammatic overall view of a drive device for prefeed apparatus with a step motor, in which the position of the main shaft of the weaving machine is detected by means of a simple coder wheel.

FIG. 4 shows a first variant of the invention, in which the components of the rotary drive device are only shown to their full extent for a single prefeed and measurement device 1. This device uses a simple coder wheel 24, i.e. a wheel which only comprises a single circular track with uniformly spaced divisions, similar to the central track 20 of the coder wheel of FIG. 2, and producing a single pulse sequence D. An electronic computer 25 is interposed between the coder wheel 24 and the switching system 15 so as to convert the pulses D which it receives as pulses having different spacings, in accordance with a memorised law, so as to provide pulses enabling the control of the acceleration and deceleration stages of the step motor 8, similar to the pulses A, C supplied directly by the special coder wheel 13 of the first embodiment.

Figure 5:
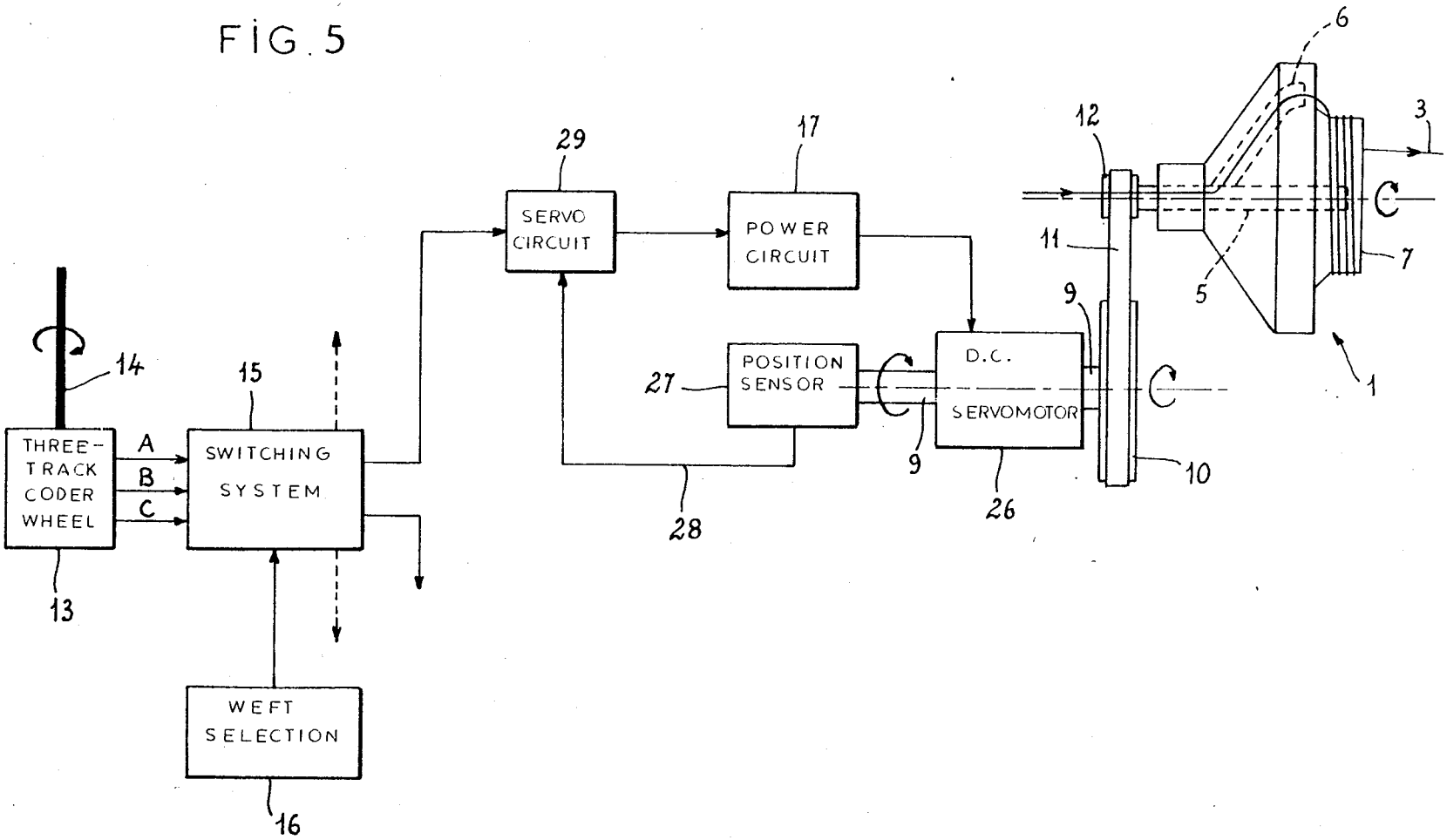
FIG. 5 is a diagrammatic overall view of a drive device for prefeed apparatus with a servo-operated d.c. motor, in which the position of the main shaft of the weaving machine is detected by means of a three-track coder wheel.
Figure 6:
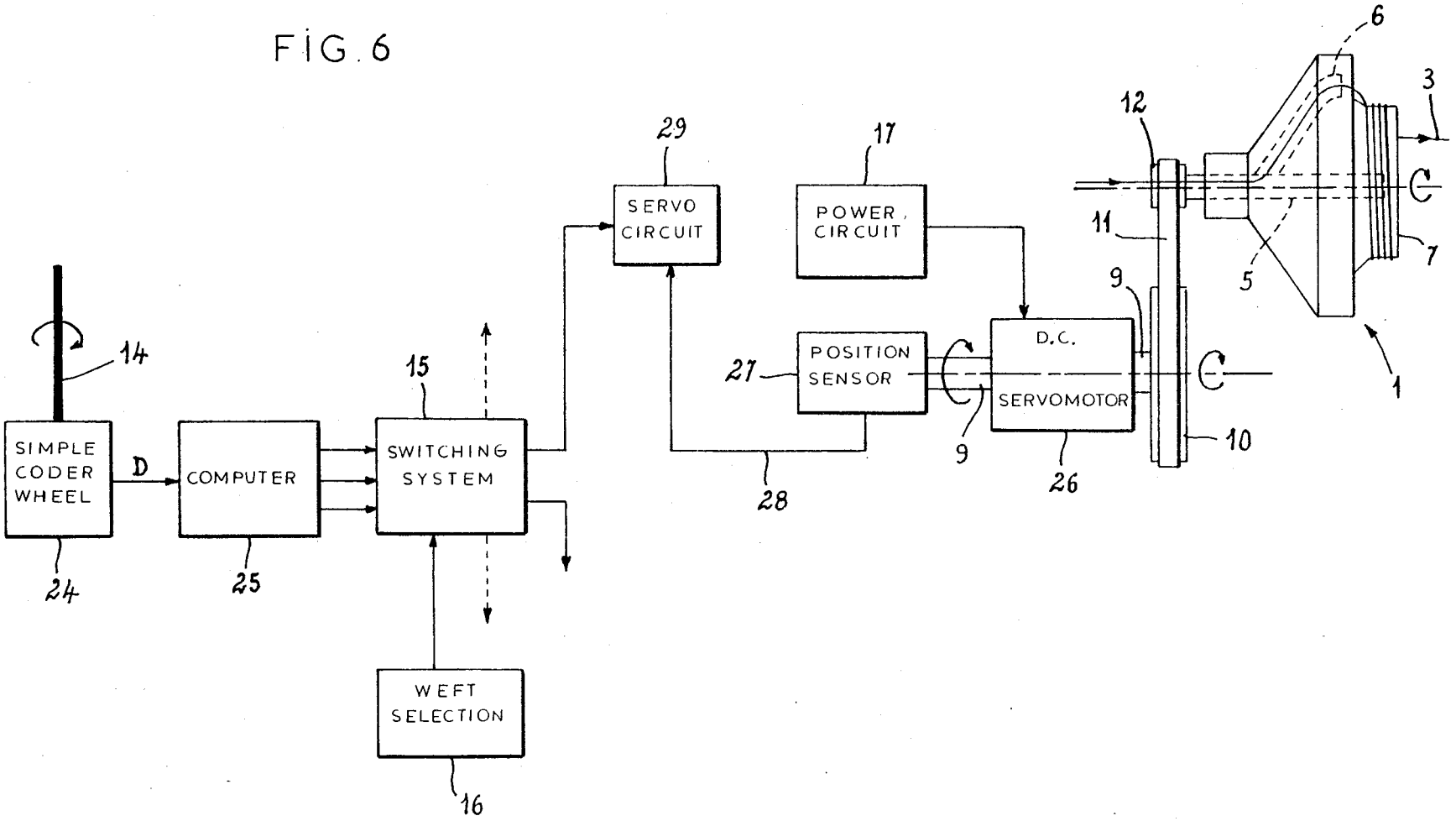
FIG. 6 is a diagrammatic overall view of a drive device for prefeed apparatus with a servo-operated d.c. motor, in which the position of the main shaft of the weaving machine is detected by means of a simple coder wheel.

FIGS. 5 and 6 relate to further embodiments, in which the electric motor of the step type associated with each prefeed device is replaced by a servo-operated d.c. motor 26.

The angular position of the shaft 9 of the d.c. motor 26 is detected in this case by a position sensor 27, from which there extends a feedback loop 28 which terminates at an electronic servo circuit 29 which receives, on one hand, the commands emitted by the switching system 15 and, on the other hand, the return signal supplied by the sensor 27.

In the case of FIG. 5, the device uses a three-track coder wheel 13 identical to that of FIG. 2, which generates the pulses A, B, C for the respective control of the acceleration, rotation at a constant speed and deceleration stages.

In the case of FIG. 6, the device uses a simple coder wheel 24, generating a single pulse sequence D which is processed by an electronic computer 25 in a similar way to the variant of FIG. 4.

It is obvious that the invention is not limited to the embodiments of this rotary drive device for a weft prefeed and measurement device which have been described above by way of example. The invention also covers all structural variants and different applications which use the same principle. The scope of the invention therefore includes:

the replacement of the electric step or d.c. motors by any electric motor having a controlled angular position, with open or closed loop control systems;

the use of a different synchronous transmission between these motors and the associated prefeed devices, or even the arrangement of these motors coaxially to the prefeed devices;

the application of the device to a weaving machine equipped with any number of prefeed devices.

We claim:

1. In a device for the rotational drive of weft prefeed and measurement devices, in a shuttle-less weaving machine which comprises a weft selector enabling a selected one of a plurality of weft threads supplied from respective lateral weft stores to be inserted at will, with a respective prefeed and measurement device having a rotary finger which stores a predetermined length of weft thread in a cyclical manner disposed in the path of each weft thread, the improvement which comprises:

for each weft prefeed and measurement device, an electric motor having a controlled angular position having its output shaft coupled to the shaft of the prefeed and measurement device;

a control assembly comprised of electronic power circuits associated with said electric motors;

means for detecting the angular position of the main shaft of the weaving machine and for translating this position into electrical signals; and means which can be switched by a weft selection control of the machine and adapted to process the electrical signals supplied by said detecting means, by supplying them to the power circuits associated with the electric motor of the selected prefeed and measurement device, the means for detecting the angular position of the main shaft of the weaving machine and for translating this position into electrical signals comprising a coder wheel which is rotationally coupled to the said main shaft and comprises three concentric circular tracks, with a first track comprising unequally spaced divisions and provided such that each angular interval between two successive divisions corresponds to a basic rotation of a motor during an acceleration stage of the prefeed device associated therewith, with a second track comprising equally spaced divisions for the control of the rotation at a constant speed of a prefeed device and with a third track comprising unequally spaced divisions and provided such that each angular interval between two successive divisions corresponds to a basic rotation of a motor during a deceleration stage of the prefeed device associated therewith, the signals produced by these three tracks being transmitted to the means which may be switched from the weft selection control and are designed to supply the signals to the power circuits.

2. A device for the rotational drive of a weft prefeed and measurement device as claimed in claim 1, wherein the electric motor associated with each prefeed device is a stepping electric motor whose angular position is controlled from the detection of the position of the main shaft of the weaving machine.

3. A device for the rotational drive of a weft prefeed and measurement device as claimed in claim 1, wherein the electric motor associated with each prefeed device is a d.c. motor, of the servo-operated type, a position sensor being provided for the detection of the angular position of the shaft of this electric motor and for the supply of the servo return signal.

4. A device for the rotational drive of weft prefeed and measurement device as claimed in claim 1, wherein on the coder wheel, the number of divisions of the first track and the third track corresponding to the acceleration and deceleration stages respectively, is equal to half the number of divisions of the second track provided for the control of the rotation at a constant speed.

5. A device for the rotational drive of a weft prefeed and measurement device as claimed in claim 1, wherein the coder wheel comprises a fourth circular track which is coaxial to the three other tracks and is provided with a single marking provided for the generation of a track switching signal.

* * * * *